US006370701B1

(12) United States Patent
Siegrist

(10) Patent No.: US 6,370,701 B1
(45) Date of Patent: Apr. 16, 2002

(54) URINE COLLECTION DEVICE

(76) Inventor: William Siegrist, 6 Wood Dale Ct., Sussex, NJ (US) 07461

( * ) Notice: Subject to any disclaimer, the term of this patent is extended or adjusted under 35 U.S.C. 154(b) by 0 days.

(21) Appl. No.: 09/621,970

(22) Filed: Jul. 21, 2000

(51) Int. Cl.[7] ..... A47K 11/12
(52) U.S. Cl. ..... 4/144.1
(58) Field of Search ..... 4/144.1, 144.3, 4/144.2; 604/327; 215/306, 384; 220/771; D9/530; D3/201, 202

(56) References Cited

U.S. PATENT DOCUMENTS 1,924,242 A * 8/1933 Kaye ..... 215/306
D91,653 S * 3/1934 Guyer ..... D9/543
2,358,850 A 9/1944 Chenault
4,164,795 A 8/1979 Johnson
4,270,231 A 6/1981 Zint
4,885,809 A * 12/1989 Muchmore ..... 4/259
D322,358 S * 12/1991 Jacober et al. ..... D3/301
5,309,578 A 5/1994 Temple, Sr.
5,411,495 A * 5/1995 Willingham ..... 604/329
D360,943 S 8/1995 Lafond
5,439,456 A * 8/1995 Fabricant ..... 604/327
5,797,147 A 8/1998 Young et al.

* cited by examiner

*Primary Examiner*—Charles E. Phillips

(57) ABSTRACT

A urine collection device for permitting a hunter to conveniently store urine while using a hunting stand without leaving a scent to scare animals from the hunting area. The urine collection device includes a container for collecting urine which has front and rear walls with side walls extending between the front and rear walls as well as top and bottom walls extending between the front and rear walls, an opening formed in the top wall of the container, and a cap for closing the opening of the container.

14 Claims, 3 Drawing Sheets

URINE COLLECTION DEVICE

BACKGROUND OF THE INVENTION

1. Field of the Invention

The present invention relates to urine collection devices and more particularly pertains to a new urine collection device for permitting a hunter to conveniently store urine while using a hunting stand without leaving a scent to scare animals from the hunting area.

2. Description of the Prior Art

The use of urine collection devices is known in the prior art. More specifically, urine collection devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,309,578; 4,270,231; 2,358,850; 5,797,147; 4,164,795; and U.S. Pat. No. Des. 360,943.

While these devices fulfill their respective, particular objectives and requirements, the aforementioned patents do not disclose a new urine collection device. The inventive device includes a container for collecting urine which has front and rear walls with side walls extending between the front and rear walls as well as top and bottom walls extending between the front and rear walls, an opening formed in the top wall of the container, and a cap for closing the opening of the container.

In these respects, the urine collection device according to the present invention substantially departs from the conventional concepts and designs of the prior art, and in so doing provides an apparatus primarily developed for the purpose of permitting a hunter to conveniently store urine while using a hunting stand without leaving a scent to scare animals from the hunting area.

SUMMARY OF THE INVENTION

In view of the foregoing disadvantages inherent in the known types of urine collection devices now present in the prior art, the present invention provides a new urine collection device construction wherein the same can be utilized for permitting a hunter to conveniently store urine while using a hunting stand without leaving a scent to scare animals from the hunting area.

The general purpose of the present invention, which will be described subsequently in greater detail, is to provide a new urine collection device apparatus and method which has many of the advantages of the urine collection devices mentioned heretofore and many novel features that result in a new urine collection device which is not anticipated, rendered obvious, suggested, or even implied by any of the prior art urine collection devices, either alone or in any combination thereof.

To attain this, the present invention generally comprises a container for collecting urine which has front and rear walls with side walls extending between the front and rear walls as well as top and bottom walls extending between the front and rear walls, an opening formed in the top wall of the container, and a cap for closing the opening of the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new urine collection device apparatus and method which has many of the advantages of the urine collection devices mentioned heretofore and many novel features that result in a new urine collection device which is not anticipated, rendered obvious, suggested, or even implied by any of the prior art urine collection devices, either alone or in any combination thereof.

It is another object of the present invention to provide a new urine collection device which may be easily and efficiently manufactured and marketed.

It is a further object of the present invention to provide a new urine collection device which is of a durable and reliable construction.

An even further object of the present invention is to provide a new urine collection device which is susceptible of a low cost of manufacture with regard to both materials and labor, and which accordingly is then susceptible of low prices of sale to the consuming public, thereby making such urine collection device economically available to the buying public.

Still yet another object of the present invention is to provide a new urine collection device which provides in the apparatuses and methods of the prior art some of the advantages thereof, while simultaneously overcoming some of the disadvantages normally associated therewith.

Still another object of the present invention is to provide a new urine collection device for permitting a hunter to conveniently store urine while using a hunting stand without leaving a scent to scare animals from the hunting area.

Yet another object of the present invention is to provide a new urine collection device which includes a container for collecting urine which has front and rear walls with side walls extending between the front and rear walls as well as top and bottom walls extending between the front and rear walls, an opening formed in the top wall of the container, and a cap for closing the opening of the container.

Still yet another object of the present invention is to provide a new urine collection device that increases safety by reducing the need to repeatedly ascend and descend from a tree stand.

Even still another object of the present invention is to provide a new urine collection device that is marked in a pattern such as camouflage, which does not alert game animals through a visual signal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
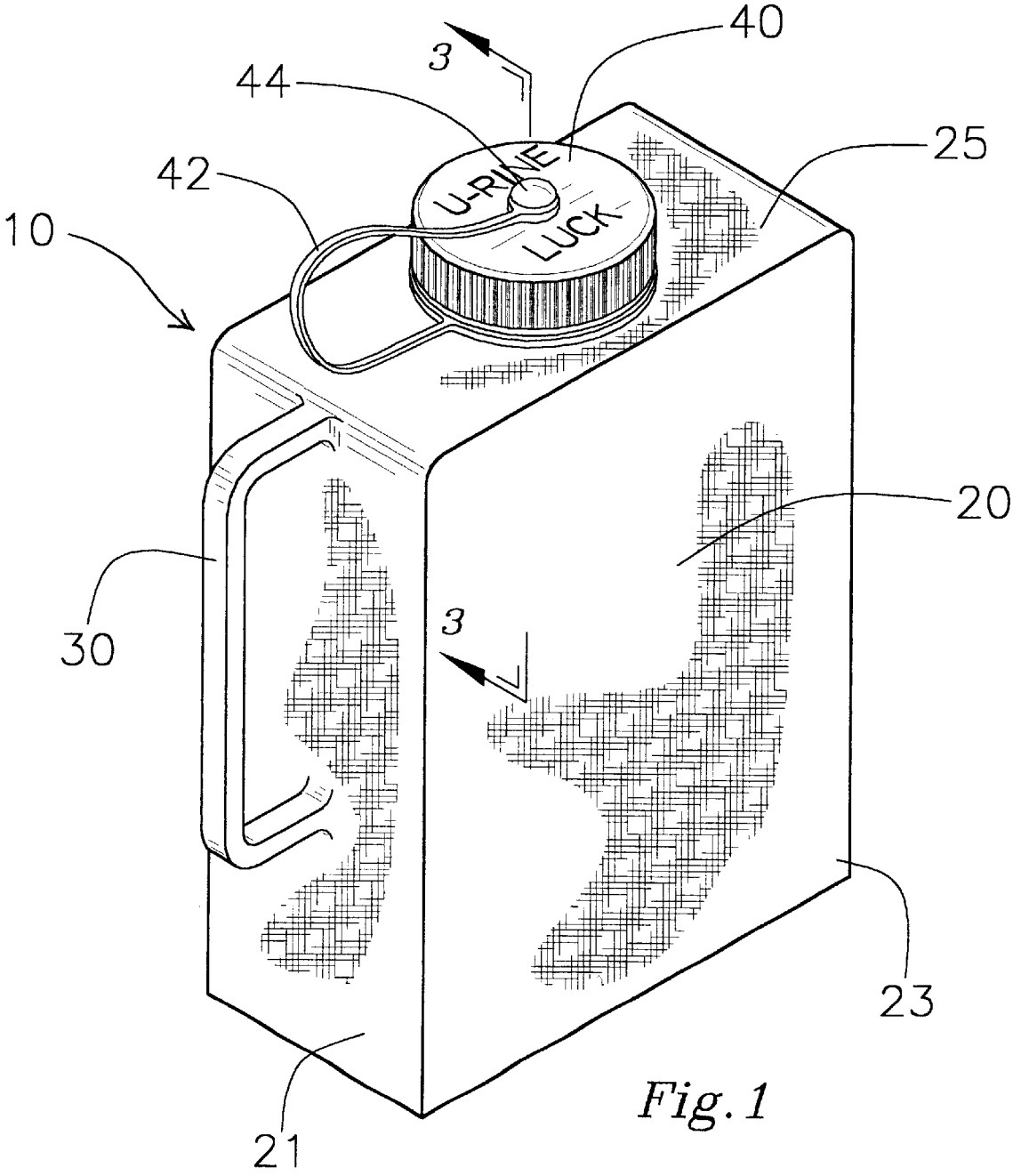
FIG. 1 is a schematic perspective view of a new urine collection device according to the present invention.
Figure 2:
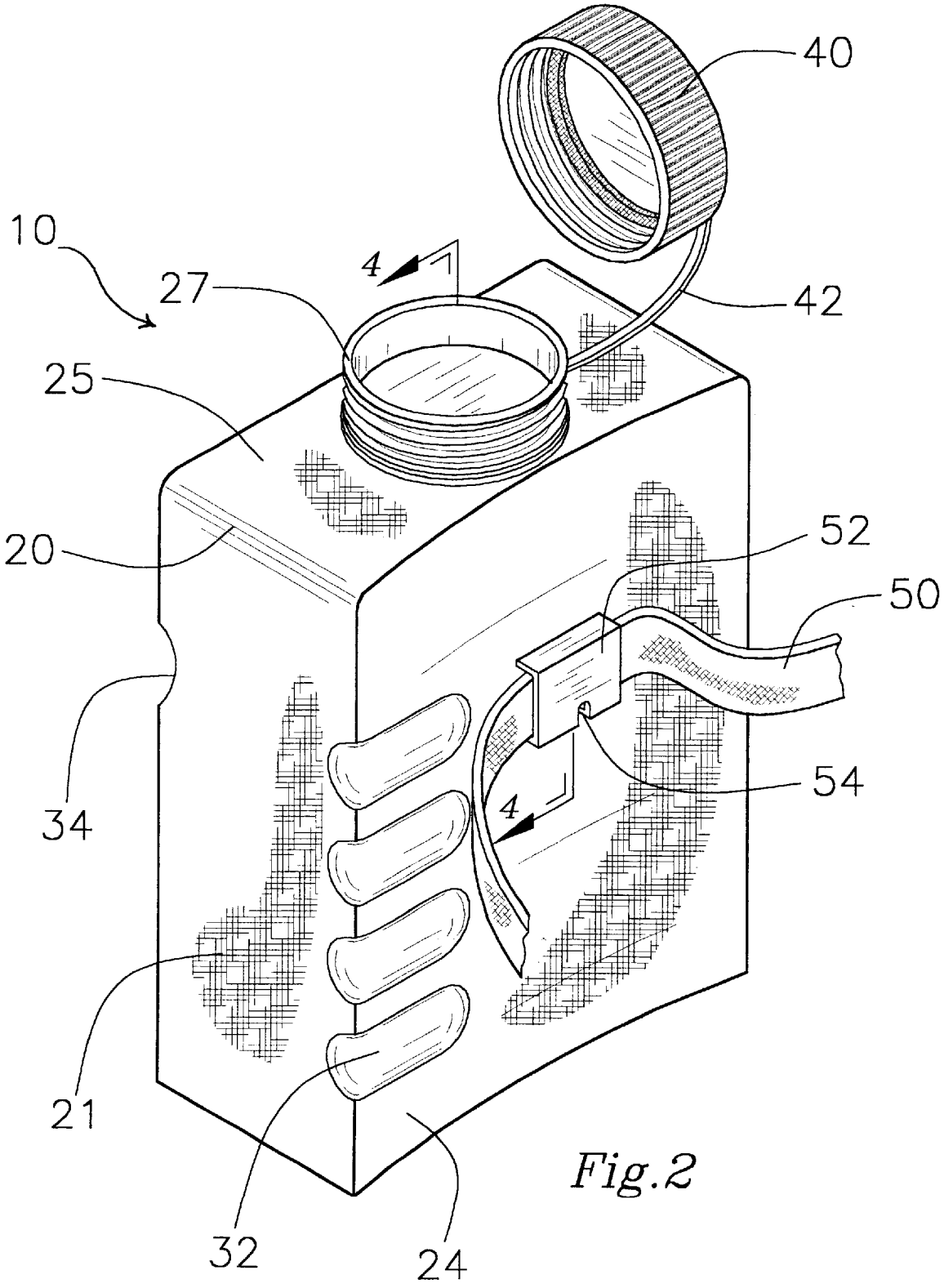
FIG. 2 is a schematic rear view of the present invention.
Figure 3:
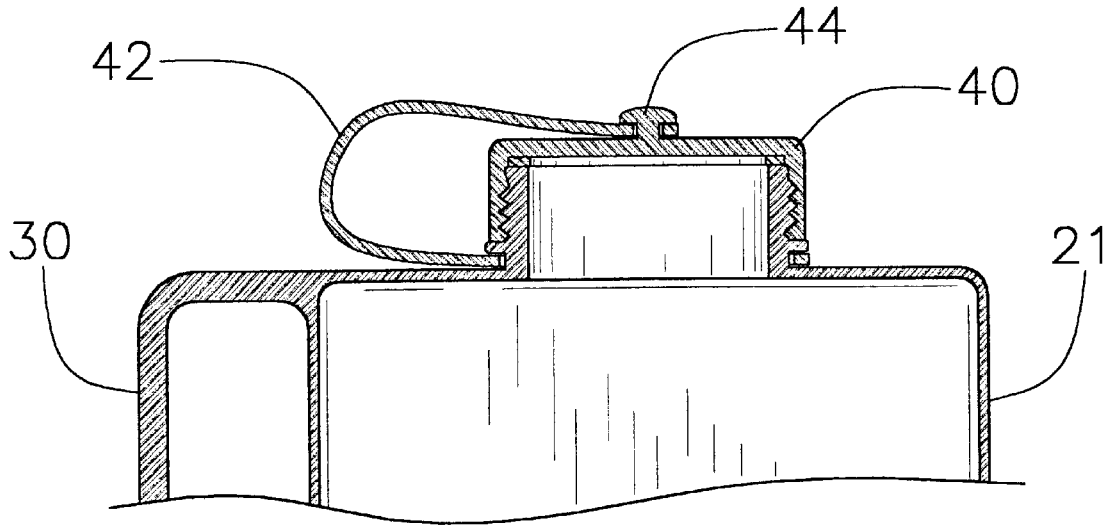
FIG. 3 is a schematic detail view of the cap and spout wall of the present invention.
Figure 4:
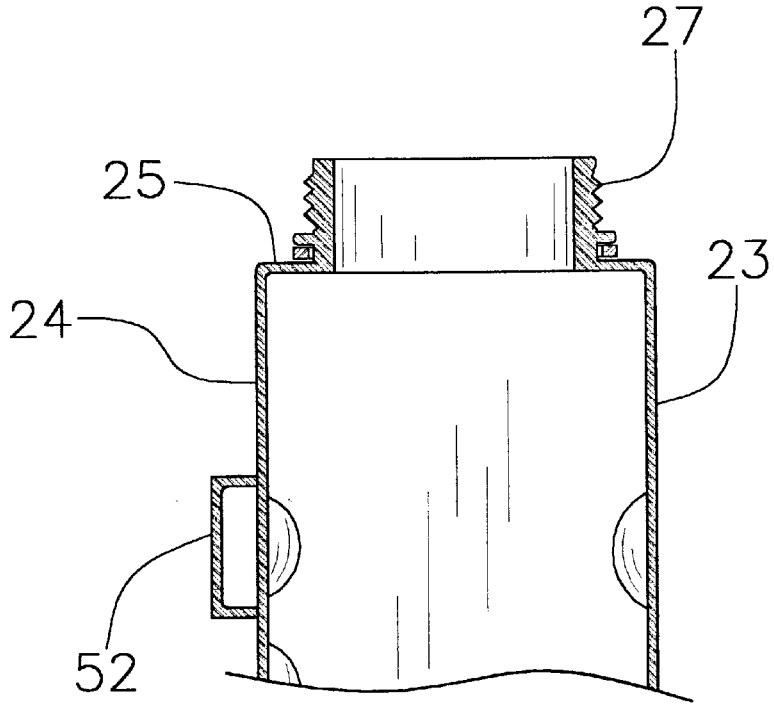
FIG. 4 is a schematic side view of the present invention.

With reference now to the drawings, and in particular to FIGS. 1 through 4 thereof, a new urine collection device embodying the principles and concepts of the present invention and generally designated by the reference numeral 10 will be described.

As best illustrated in FIGS. 1 through 4, the urine collection device 10 generally comprises a container 20 for collecting urine, a cap 40 for closing the opening of the container 20 and a strap 50 for securing the container 20. The container 20 has a front wall 23 and a back wall 24. The container 20 has two side walls 21 each of which extend between the front 23 and back walls 24. The container 20 also has a top wall 25 and a bottom wall 26 which extend between the front 23 and rear walls 24. Each of the walls is substantially rectangular in shape.

In an embodiment a handle 30 is mounted on a side wall 21 of the container. The handle 30 comprises a generally U-shaped member. The ends of the U-shaped member are mounted on the side wall 21.

In an embodiment the rear wall 23 has a central potion which extends between the top 25 and bottom walls 26 and marginal portions which extend between the top 25 and bottom walls 26. The central portion is located relatively closer to the front wall 23 than to the marginal portion of the rear wall 24. The rear wall 24 has an arcuate cross section in a plane extending substantially parallel to the bottom wall 26.

In a further embodiment the container 20 is provided with a plurality of channels. These channels facilitate gripping of the container by hand. A plurality of finger channels 32 is formed into the rear wall 24 of the container 20. A thumb channel 34 is formed into the front wall 23 of the container 20. The finger channels 32 are elongate and extend substantially parallel to each other. The channels extend from one side wall 21 of the container 20.

In still a further embodiment a strap retainer 52 is mounted on the container 20 for permitting the container 20 to be attached to a strap 50. The strap retainer 52 has a passage through it for receiving a strap 50, and is mounted to the rear wall 24 of the container 20. The strap retainer 52 also has a notch 54 extending upward from the bottom edge of the retainer 52. The notch 54 facilitates hanging the container 20 from a nail, peg, or screw.

In an embodiment the outer surface of the walls of the container 20 are marked with a camouflage pattern.

In an embodiment an opening is formed in the top wall 25 of the container 20. A spout wall 27 is mounted to a perimeter of the opening and extends away from the top wall 25.

The cap 40 has an interior surface. Threads are formed on the interior surface for engaging threads formed on an outer surface of the spout wall 27. The cap 40 has an attachment strap 42 that is used to attach the cap 40 to the container 20. The cap attachment strap 42 has a first end which is mounted on the cap 40 and a second end which is mounted on the container 20 adjacent to the spout wall 27. The cap attachment strap 42 is rotatably mounted on an upper wall of the cap 40 which permits the cap to rotate relative to the cap attachment strap 42. The first end of the cap attachment strap 42 has a first loop. The cap 40 has an attachment button 44 which extends upward from the upper wall of the cap 40. The attachment button 44 has an annular groove for receiving the first loop. The second end of the cap attachment strap 42 is rotatably mounted on the spout wall 27. The second end of the cap securing strap has a second loop. The spout wall 27 of the container 20 has an annular groove for receiving the second loop of the cap attachment strap 42.

The strap 50 is used to secure the container to an upstanding member such as a tree. The container 20 is positioned with the arcuate rear wall 24 adjacent to a side of the tree.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A urine collection device, comprising:

A container for containing urine, the container having a front wall and a rear wall, side walls extending between the front and rear walls, top and bottom walls extending between the front and rear walls, an opening being formed in the top wall of the container;

a cap for closing the opening of the container;

a strap retainer is mounted on the container for permitting the container to be attached to a strap, the strap retainer having a passage therethrough for receiving a strap;

wherein the container is provided with a plurality of channels for facilitating hand gripping of the container by a hand of a user, said plurality of channels including a plurality of finger channels formed in the rear wall of the container and thumb channel formed in the front wall of the container;

wherein the rear wall has a central portion extending between the top and bottom walls and marginal portions located on each side of the central portion and extending between the top and bottom walls, the central portion being spaced from the front wall a relatively smaller distance than a distance between the marginal portions of the rear wall and the front wall and said strap retainer is mounted on said central portion and has a passage therethrough for receiving a strap.

2. The device of claim 1 additionally comprising a strap for securing the container to a upstanding member, the strap being extendable through the strap retainer for securing the strap about a tree with a side of the tree positioned adjacent to the rear wall of the container.

3. The device of claim 1 wherein a spout wall is mounted to a perimeter of the opening and extending away from the top wall.

4. The device of claim 3 wherein the cap has an interior surface with threads formed thereon for engaging threads formed on an outer surface of the spout wall.

5. The device of claim 1 wherein the rear wall has an arcuate cross-section in a plane extending substantially parallel to the bottom wall.

6. The device of claim 1 wherein the channels extend from one of the side walls of the container.

7. The device of claim 1 wherein the strap retainer is mounted to the rear wall of the container.

8. The device of claim 1 wherein the finger channels are elongate and extend substantially parallel to each other.

9. The device of claim 1 additionally comprising a cap attachment strap for attaching the cap to the container, the cap attachment strap having a first end mounted on the cap and a second end mounted on the container adjacent the spout wall.

10. The device of claim 9 wherein the cap attachment strap is rotatably mounted on an upper wall of the cap to permit rotation of the cap with respect to the cap attachment strap.

11. The device of claim 10 wherein the first end of the cap attachment strap having a first loop, the cap having attachment button extending the upper wall, the attachment wall having an annular groove receiving the first loop of the cap attachment strap.

12. The device of claim 9 wherein the second end of the cap attachment strap is rotatably mounted on the spout wall.

13. The device of claim 12 wherein the second end of the cap attachment strap has a second loop, the spout wall of the container having an annular groove receiving the second loop of the cap attachment strap.

14. A urine collection device, comprising:

a container for containing urine, the container having a front wall and a rear wall, side walls extending between the front and rear walls, top and bottom walls extending between the front and rear walls, each of the walls being substantially rectangular;

wherein the rear wall has a central portion extending between the top and bottom walls and marginal portions located on each side of the central portion and extending between the top and bottom walls, the central portion being spaced from the front wall a relatively smaller distance than a distance between the marginal portions of the rear wall and the front wall;

wherein the container is provided with a plurality of channels for facilitating hand gripping of the container by a user, a plurality of finger channels being formed in the rear wall of the container and a thumb channel being formed in the front wall of the container, the finger channels being elongate and extending substantially parallel to each other, the channels extending from one of the side walls of the container;

wherein a strap retainer is mounted on the container for permitting the container to be attached to a strap, the strap retainer having a passage therethrough for receiving a strap, the strap retainer being mounted to the rear wall of the container;

wherein the walls of the container have outer surfaces, the outer surfaces having a camouflage pattern marked thereon;

wherein an opening is formed in the top wall of the container, a spout wall being mounted to a perimeter of the opening and extending away from the top wall;

a cap for closing the opening of the container, the cap having an interior surface with threads formed thereon for engaging threads formed on an outer surface of the spout wall, and a cap attachment strap for attaching the cap to the container, the cap attachment strap having a first end mounted on the cap and a second end mounted on the container adjacent the spout wall, the cap attachment strap being rotatably mounted on an upper wall of the cap to permit rotation of the cap with respect to the cap attachment strap, the first end of the cap attachment strap having a first loop, the cap having attachment button extending the upper wall, the attachment wall having an annular groove receiving the first loop of the cap attachment strap, the second end of the cap attachment strap being rotatably mounted on the spout wall, the second end of the cap attachment strap having a second loop, the spout wall of the container having an annular groove receiving the second loop of the cap attachment strap; and a strap for securing the container to a upstanding member, the strap being for securing about a tree with a side of the tree positioned adjacent to the arcuate rear wall of the container.

* * * * *